US010094105B2

(12) United States Patent
Harnish et al.

(10) Patent No.: US 10,094,105 B2
(45) Date of Patent: Oct. 9, 2018

(54) PANEL SYSTEM AND SUPPORT MEMBER FOR USE WITH THE SAME

(71) Applicant: ARMSTRONG WORLD INDUSTRIES, INC., Lancaster, PA (US)

(72) Inventors: Scott D. Harnish, Lancaster, PA (US); Todd M. Bergman, Lititz, PA (US); Ryan D. Hanuschak, Lancaster, PA (US); Jonathan P. Van Dore, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 15/706,695

(22) Filed: Sep. 16, 2017

(65) Prior Publication Data

US 2018/0087263 A1 Mar. 29, 2018

Related U.S. Application Data

(60) Provisional application No. 62/398,952, filed on Sep. 23, 2016.

(51) Int. Cl.
*E04B 1/38* (2006.01)
*E04C 1/40* (2006.01)
(Continued)

(52) U.S. Cl.
CPC ..... *E04B 1/2403* (2013.01); *E04B 2/721* (2013.01); *E04B 9/06* (2013.01); *E04B 9/247* (2013.01); *E04B 9/28* (2013.01); *E04B 2001/2409* (2013.01); *E04B 2001/2481* (2013.01); *E04B 2002/7466* (2013.01)

(58) Field of Classification Search
CPC ..... E04B 1/2403; E04B 2/721; E04B 9/06; E04B 9/247; E04B 9/28; E04B 1/363; E04B 9/26; E04B 9/245; E04F 13/0803
See application file for complete search history.

(56) References Cited

U.S. PATENT DOCUMENTS 3,708,941 A * 1/1973 Cuckson ..... E04B 9/065 52/506.08
4,095,385 A * 6/1978 Brugman ..... E04B 9/247 52/506.08

(Continued)

FOREIGN PATENT DOCUMENTS

EP 0137591 A2 4/1985

OTHER PUBLICATIONS

International Search Report for corresponding Application No. PCT/US2017/051941 dated Dec. 22, 2017. WO.

*Primary Examiner* — Brian David Mattei
(74) *Attorney, Agent, or Firm* — Craig M Sterner

(57) ABSTRACT

A building panel system is provided that includes a perimeter frame; a main beam attached to the perimeter frame; a carrier attached to the main beam, the carrier having a plurality of identical hook members, each of the hook members having a protruding hooking portion on only a first side of the hook member, and a non-hooking portion on a second side of the hook member, the second side being opposite the first side; and a plurality of panels removably attached to the carrier, each of the panels being attached to the carrier by engaging one of the hooking portions.

18 Claims, 19 Drawing Sheets

(51) Int. Cl.

| | |
|---|---|
| ***E04B 1/24*** | (2006.01) |
| ***E04B 9/24*** | (2006.01) |
| ***E04B 9/28*** | (2006.01) |
| ***E04B 2/72*** | (2006.01) |
| ***E04B 9/06*** | (2006.01) |
| *E04B 2/74* | (2006.01) |

(56) References Cited

U.S. PATENT DOCUMENTS 4,270,327 A * 6/1981 Van Leeuwen ..... E04B 2/96 52/506.08
4,309,858 A * 1/1982 Anderle ..... E04B 9/36 52/506.08
4,328,653 A * 5/1982 Anderle ..... E04B 9/363 52/460
4,441,297 A 4/1984 Rijnders
4,646,506 A * 3/1987 Slapsys ..... E04B 9/363 52/460
4,660,348 A * 4/1987 LaLonde ..... E04B 9/06 52/506.08
4,671,041 A * 6/1987 Rijnders ..... E04B 9/26 52/506.09
6,336,302 B1 1/2002 Brugman et al.
8,316,601 B2 * 11/2012 Cobb ..... E04B 5/48 137/357
2004/0055239 A1 3/2004 Hang
2004/0148894 A1 * 8/2004 Kelley ..... E04B 9/003 52/506.01
2004/0172907 A1 * 9/2004 Krantz-Lilienthal ... E04B 9/064 52/506.05
2009/0094924 A1 * 4/2009 Paul ..... E04B 9/06 52/506.07
2011/0308185 A1 12/2011 Gerkes et al.
2012/0047836 A1 * 3/2012 Sareyka ..... E04B 9/068 52/506.06
2012/0055109 A1 * 3/2012 Labonte ..... E04B 9/22 52/506.05
2015/0308112 A1 * 10/2015 Holdridge ..... E04B 9/10 52/506.05

* cited by examiner

PANEL SYSTEM AND SUPPORT MEMBER FOR USE WITH THE SAME

CROSS-REFERENCE TO RELATED APPLICATIONS

This application claims the benefit of U.S. Provisional Application No. 62/398,952, filed on Sep. 23, 2016. The disclosure of the above application is incorporated herein by reference.

BACKGROUND

The present invention generally relates to panel systems such as ceiling or wall systems and brackets for use with such systems.

Some panel systems, for example plank type ceiling or wall systems, have carrier members that are attached to main beams that carry the load of the panel system. The carrier members have some type of attachment feature to which a plurality of panels such as, for example, planks, are attached.

BRIEF SUMMARY

In some panel systems, a specific carrier member is required for a specific panel size or type. This need for multiple different carriers that are panel specific results in larger inventory requirements and high costs. In some ceiling systems, a ceiling panel or plank needs to be cut in order for the panel or plank to fit in the space available. This can present a problem when the attachment feature of the panel or plank is cut off in the process because the cut panel or plank is no longer firmly attached to the carrier and can fall.

The present invention provides solutions to the above described problems. The present invention provides a carrier that allows panels of different sizes to be attached to the carrier. This is accomplished by having hooking portions of a particular shape and spacing. The present invention also provides a universal end panel bracket that securely attaches a cut end panel to the carrier without the use of unsightly screws or rivets.

According to one embodiment, a building panel system includes a perimeter frame; a main beam attached to the perimeter frame; a carrier attached to the main beam, the carrier having a plurality of identical hook members, each of the hook members having a protruding hooking portion on only a first side of the hook member, and a non-hooking portion on a second side of the hook member, the second side being opposite the first side; and a plurality of panels removably attached to the carrier, each of the panels being attached to the carrier by engaging one of the hooking portions.

In some embodiments, each of the panels is attached to the carrier by engaging two of the hooking portions.

In some embodiments, the panels are ceiling panels.

In some embodiments, the panels are wall panels.

In some embodiments, each of the plurality of panels has a first end and a second end, the second end being opposite the first end along a longitudinal direction of the carrier, the first end includes an engagement portion, and the second end extends along the longitudinal direction of the carrier.

In some embodiments, the hooking portion has a notch that engages the engagement portion of one of the panels.

In some embodiments, the hook member includes a wall opposite to the hooking portion, the wall contacting a rising portion of one of the panels, the rising portion being closer to the second end than the first end.

In some embodiments, the hook members are spaced every two inches along the carrier.

In some embodiments, the carrier has two parallel rows of the hook members.

In some embodiments, each of the panels has a first end and a second end, and the building panel system further includes a universal end panel bracket. The universal end panel bracket has a notch configured to engage an edge of an uncut end of a first panel of the plurality of panels, the first panel having its first end cut off, the notch preventing movement of the first panel in a longitudinal direction of the carrier; and a ledge configured to contact an inside surface of an uncut end of a second panel of the plurality of panels, the second panel having its second end cut off, the ledge supporting the second panel to prevent movement of the second panel in a longitudinal direction of the carrier. The universal end panel bracket is configured to be attached to the carrier.

According to another embodiment, a carrier is configured for use with a building panel system, the building panel system having a perimeter frame, a main beam attached to the perimeter frame, and a plurality of panels. The carrier has a main beam attachment surface configured to be attached to the main beam; and a plurality of identical hook members, each of the hook members having a protruding hooking portion on only a first side of the hook member, and a non-hooking portion on a second side of the hook member, the second side being opposite the first side. The hook members are configured to receive the plurality of panels such that the panels are removably attached to the carrier, and the hook members are configured such that each of the panels is attachable to the carrier by engaging one of the hooking portions.

According to another embodiment, a building panel system includes a perimeter frame; a main beam attached to the perimeter frame; a carrier attached to the main beam, the carrier having a longitudinal direction and a plurality of identical hook members arranged along the longitudinal direction, each of the hook members having a first side and a second side opposite the first side, the first side and the second side being arranged relative to each other along the longitudinal direction of the carrier, and the first side and the second side being non-symmetrical, and a protruding hooking portion on the first side; and a plurality of panels removably attached to the carrier, each of the panels being attached to the carrier by engaging one of the hooking portions.

According to another embodiment, a building panel system includes a perimeter frame; a main beam attached to the perimeter frame; a carrier attached to the main beam, the carrier having a longitudinal direction and a plurality of identical hook members arranged along the longitudinal direction, each of the hook members having a first side and a second side opposite the first side, the first side and the second side being arranged relative to each other along the longitudinal direction of the carrier, and a protruding hooking portion on the first side; and a plurality of panels removably attached to the carrier, each of the panels being attached to the carrier by engaging one of the hooking portions. One of the panels extends past and completely beyond a first one of the hook members without engaging the first one of the hook members.

According to another embodiment, a building panel system includes a perimeter frame; a main beam attached to the perimeter frame; a carrier attached to the main beam, the carrier having a longitudinal direction and a plurality of identical hook members arranged along the longitudinal direction and spaced at a distance d in the longitudinal direction, each of the hook members having a first side and a second side opposite the first side, the first side and the second side being arranged relative to each other along the longitudinal direction of the carrier, and a protruding hooking portion on the first side; and a plurality of panels removably attached to the carrier, each of the panels being attached to the carrier by engaging one of the hooking portions. One of the panels extends in the longitudinal direction at least a distance D, where D is X times as large as d, X is an integer, and X is at least 2.

According to another embodiment, a universal end panel bracket is for use with a building panel system having a perimeter frame, a main beam attached to the perimeter frame, a carrier attached to the main beam, and a plurality of panels removably attached to the carrier, the carrier having a plurality of identical hook members, each of the hook members having a protruding hooking portion on only a first side of the hook member, and a non-hooking portion on a second side of the hook member, the second side being opposite the first side, each of the panels having a first end and a second end, and each of the panels being attached to the carrier by engaging one of the hooking portions. The universal end panel bracket has a notch configured to engage an edge of an uncut end of a first panel of the plurality of panels, the first panel having its first end cut off, the notch preventing movement of the first panel in a longitudinal direction of the carrier; and a ledge configured to contact an inside surface of an uncut end of a second panel of the plurality of panels, the second panel having its second end cut off, the ledge supporting the second panel to prevent movement of the second panel in a longitudinal direction of the carrier. The universal end panel bracket is configured to be attached to the carrier.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
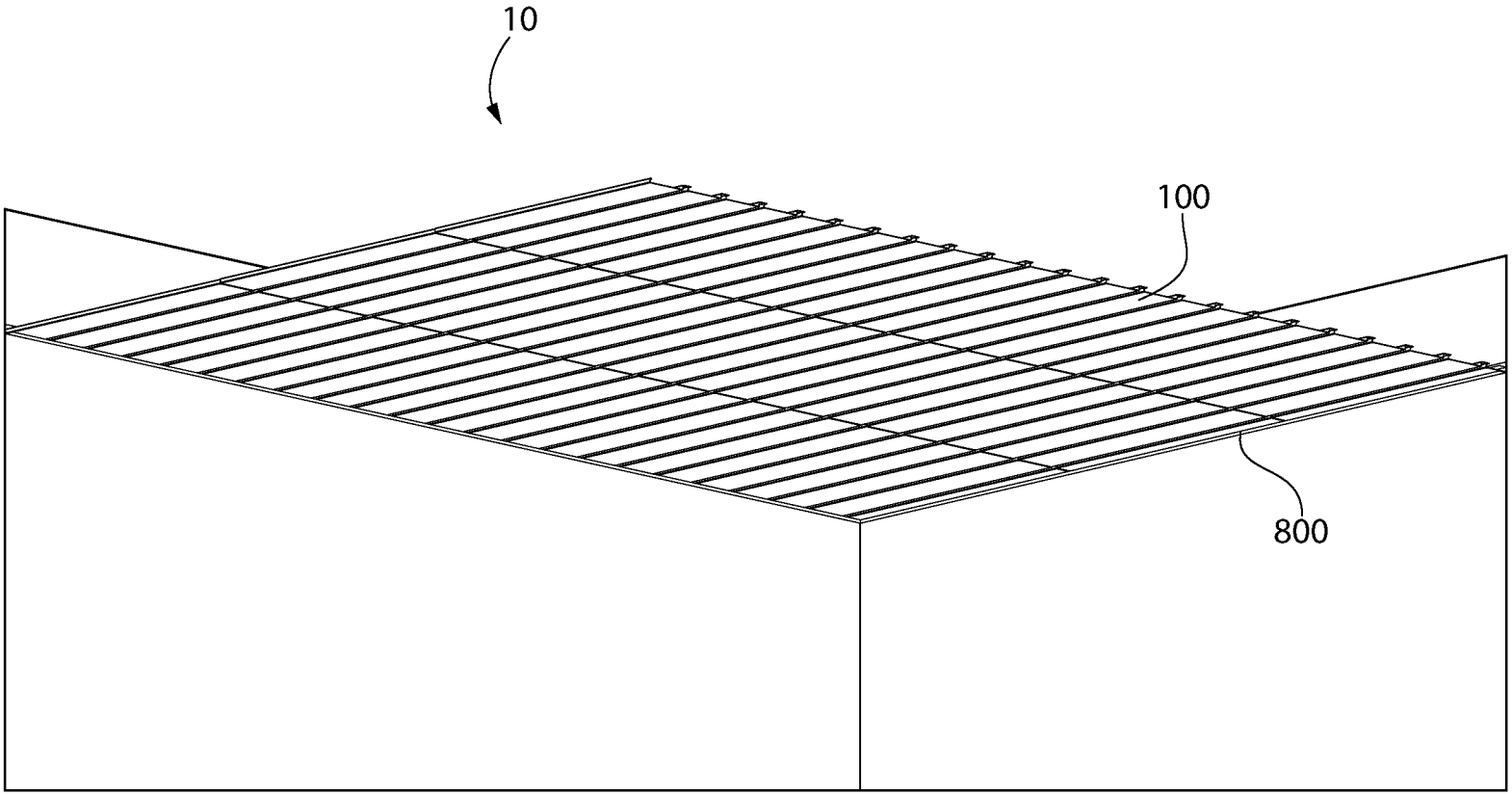
FIG. 1 is a view of a ceiling system according to exemplary embodiments of the invention in an installed condition.

The following description of embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

FIG. 1 illustrates a ceiling system 10 that spans from wall to wall and separates a building occupied space from a plenum space. In this example, ceiling system 10 is a plank system that includes a number of main beams that support a number of panels or planks 100. The main beams are attached at their wall ends to a perimeter frame 800. The main beams may or may not be additionally supported by wires, cables, tie rods, hangers, struts, or the like at positions remote from the walls of the building occupied space. The example shown in FIG. 1 is a flat system that is parallel to the floor of the occupied space. Other examples are sloped and/or curved. Still other examples are wall systems that are attached to walls of the building occupied space. Both ceiling and wall systems can have esthetic, sound control, insulation, or other properties. For simplicity, the invention will be discussed using a plank type ceiling system as an example. It is noted, however, that the features of the invention also apply to other types of wall systems and other types of ceiling systems.

The panels used in building systems in accordance with the invention can be metal, plastic, fabric, acoustical, thermal, or any other type of panel.

Figure 2:
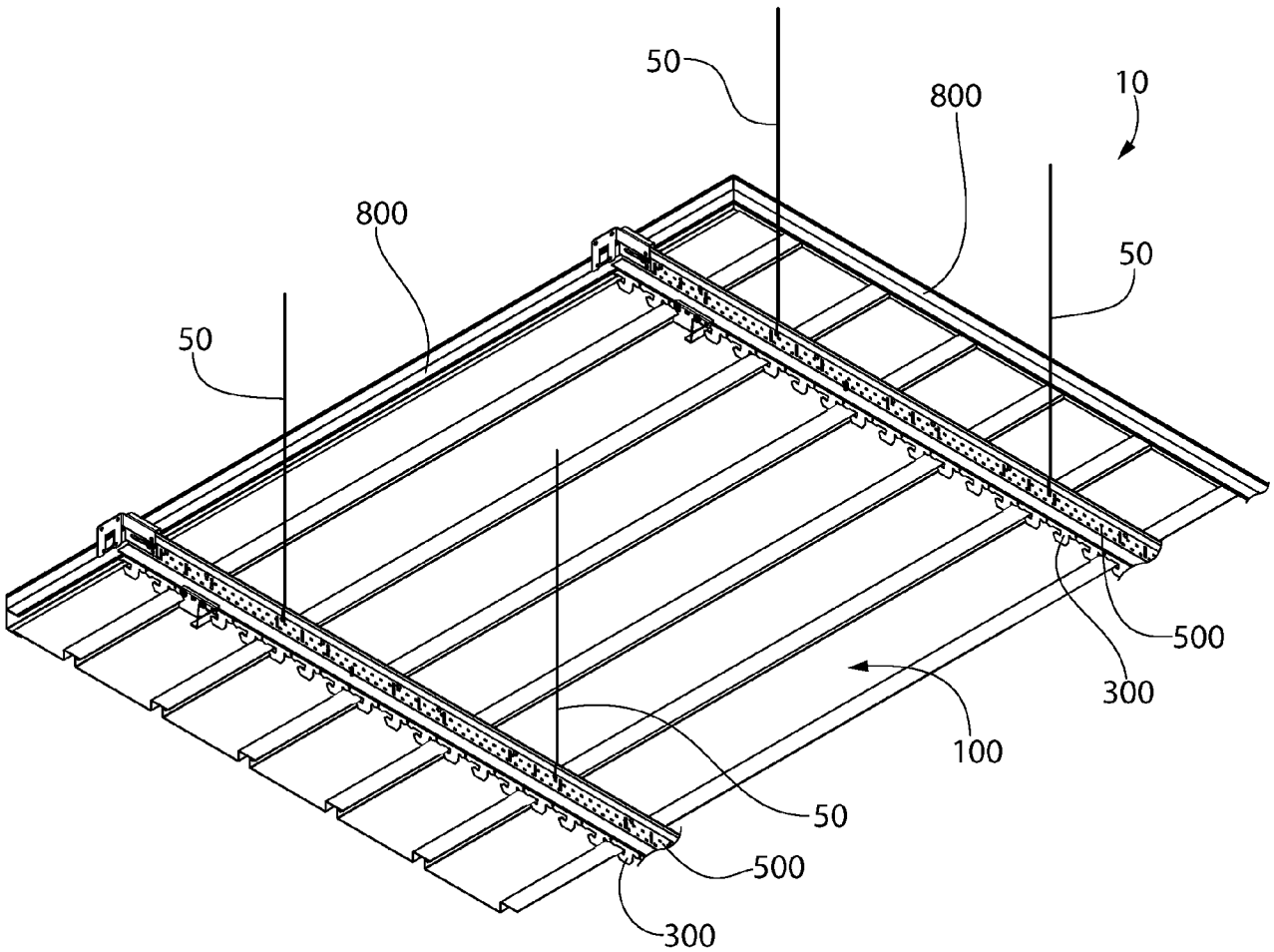
FIG. 2 is a perspective view of ceiling system according to exemplary embodiments of the invention.
Figure 3:
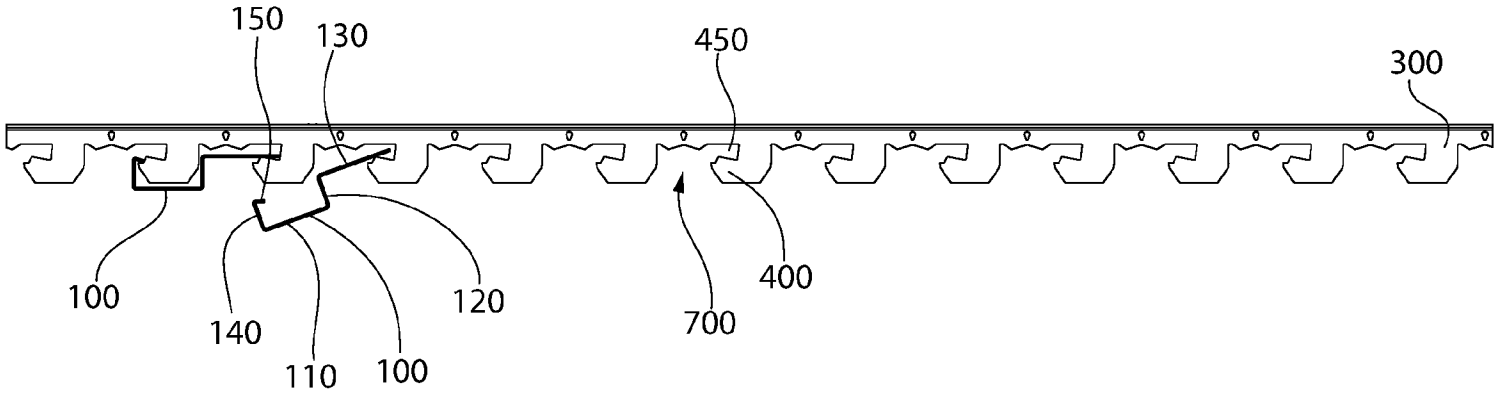
FIG. 3 is a side view of a portion of the ceiling system shown in FIG. 2.
Figure 4:
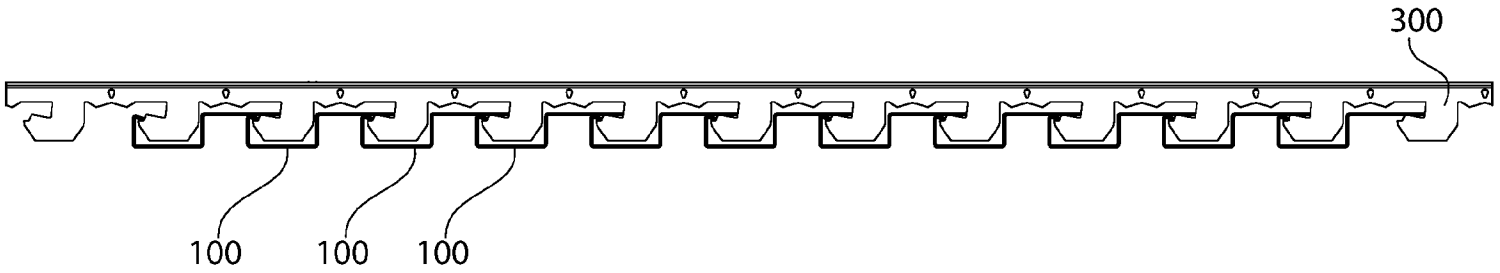
FIG. 4 is a side view of a portion of the ceiling system shown in FIG. 2.

FIGS. 2-4 show an example of a ceiling system 10 in accordance with embodiments of the invention. System 10 of FIG. 2 has a plurality of main beams 500 that are attached to perimeter frames 800 that are, in turn, attached to walls of a building space. In a rectangular room, for example, perimeter frame 800 would be attached to each wall to form a rectangular perimeter of the ceiling grid. Perimeter frame 800 can also be attached to walls that are located inside, or project into, the building space in order to support main beams 500 at their ends. In some embodiments perimeter frame 800 provides support for some or all of the weight of the ceiling system. Main beams 500 can be additionally supported by wires 50. One or more carriers 300 are attached to each main beam 500. A plurality of panels 100 are attached to carriers 300 and form a ceiling for the building space.

FIGS. 3 and 4 show sides views of main beams 300. A plurality of hook members 400 extends in a common direction (to the left in FIGS. 3 and 4) and create a space 700 between two adjacent hook members 400. A recess 450 is provided above each hook member 400. As shown in FIG. 3, an end 130 of a panel 100 is moved into one of the recesses 450 and then the other end 140 of panel 100 is pushed upward so that a bent portion 150 of panel 100 clips over hook member 400. In FIG. 3, one panel 100 is in an installed position and another panel 100 is shown being installed. FIG. 4 shows a plurality of panels 100 in the installed position.

Figure 5:
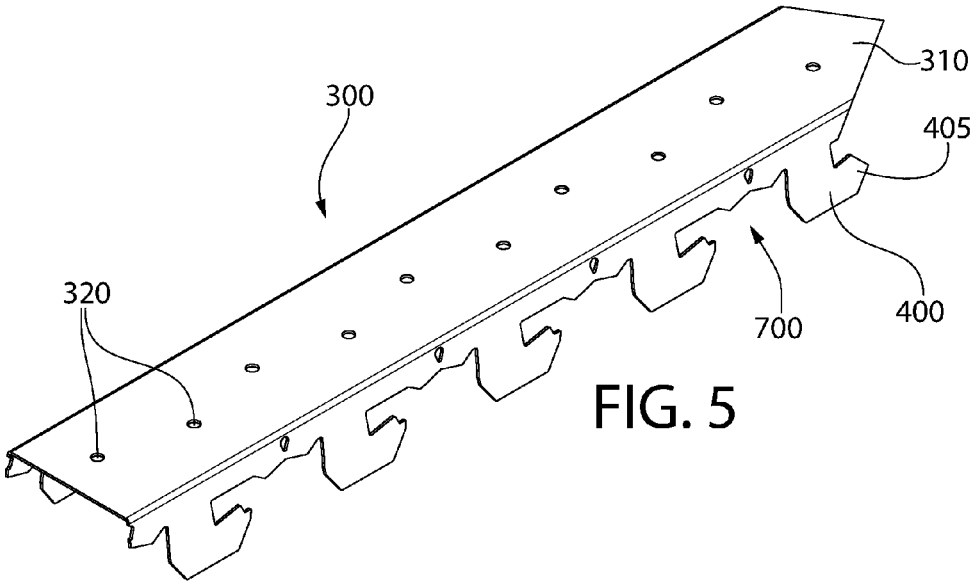
FIG. 5 is a perspective view of a carrier in accordance with exemplary embodiments of the invention.
Figure 6:
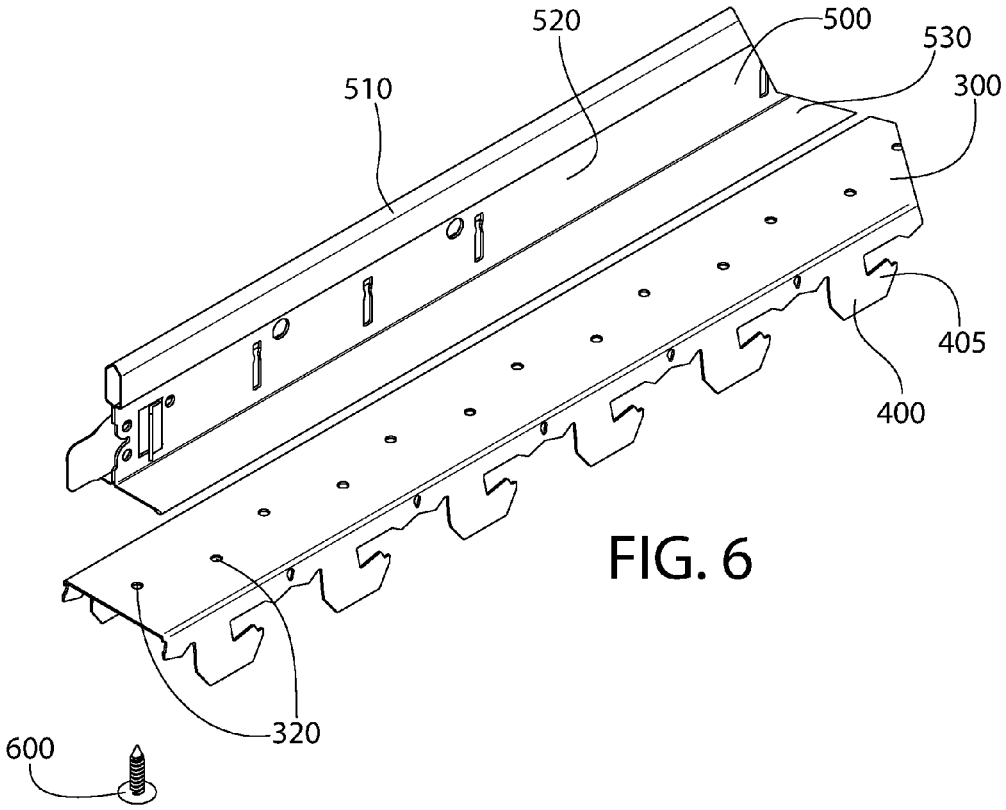
FIG. 6 is a perspective view of a main beam and carrier assembly in accordance with exemplary embodiments of the invention.
Figure 7:
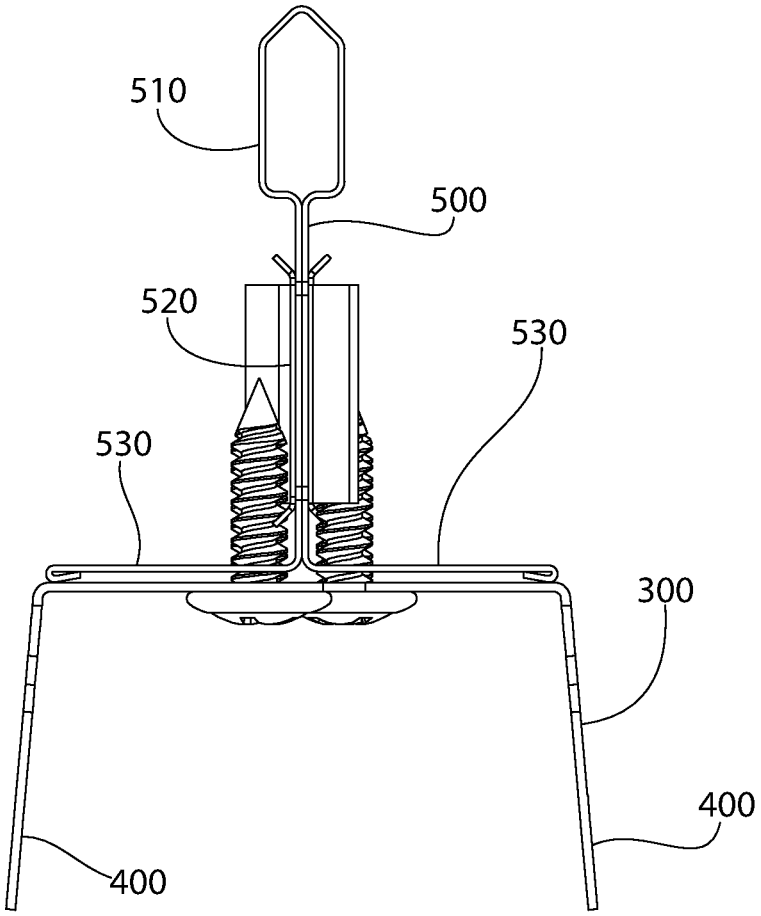
FIG. 7 is a is an end view of the embodiment shown in FIG. 6.

FIGS. 5-7 show a carrier 300 in accordance with an example of embodiments of the invention. Carrier 300 has an upper surface 310 that, in this example is configured to receive a main beam 500. Upper surface 310 has a plurality of holes 320 that receive screws 600, or other fasteners, to attach main beam 500 to carrier 300 (see FIG. 7). In the case of a ceiling system, main beam 500 is attached by some means to a building structure or other support above the ceiling system. In some cases, first ends of wires are attached to main beam 500 and the other ends of the wires are attached to the building structure or other support. Other non-exclusive examples of attachment means to the building structure or other support are rods, hangers and clips. In this example, main beam 500 has a flange 530 that provides a stabilizing surface to mate with upper surface 310 of carrier 300, and also provides structure to which screws 600 can be fastened. Main beam 500 also has a web 520 and an upper portion 510 at the upper end of web 520. Web 520 and upper portion 510 provide structural rigidity to main beam 500 and also provide attachment points for wires, rods, hangers and clips.

Although carrier 300 is discussed above relative to an example where it is used with main beam 500 in a ceiling system, it is noted that carrier 300 can be used without a main beam in other applications. For example, carrier 300 can be fastened directly to building structure above the ceiling system. In the case of wall systems, carrier 300 can be fastened directly to building structure such as, for example, vertical building structure, or can be fastened to furring or other partition construction.

FIG. 5 shows carrier 300 having a plurality of hook members 400 that create a plurality of openings 700. In the example shown in FIG. 5, carrier 300 is stamped from a piece of sheet metal and then bent at slightly less than right angles to create a channel-like structure with hook members 400 extending down away from upper surface 310. Other methods of forming carrier 300 can also be used based on the strength needed, the importance of weight, esthetic requirements, the need for corrosion resistance, or other factors. For example, carrier 300 can be formed of plastic or a composite material if reducing weight or corrosion resistance is important and/or high strength is not important. Carrier 300 can be a cast or machined piece of metal if high strength and/or esthetics are important.

Each hook member 400 shown in FIG. 5 has a hooking portion 405 extending from it. All hooking portions 405 point in the same direction along the longitudinal direction of carrier 300. Embodiments of the invention provide hooking portions pointing in only one direction in order to make a smaller overall portion that the panels have to cover. As will be explained in more detail below, a feature of the invention is that a universal carrier can be used for systems that use different size panels. Some panels will span only one hook member, while other panels will span two, three, four, or more hook members. By making the hooking portions extend in only one direction, the overall length of the portion of the carrier that has to be spanned by a panel is smaller.

Figure 8:
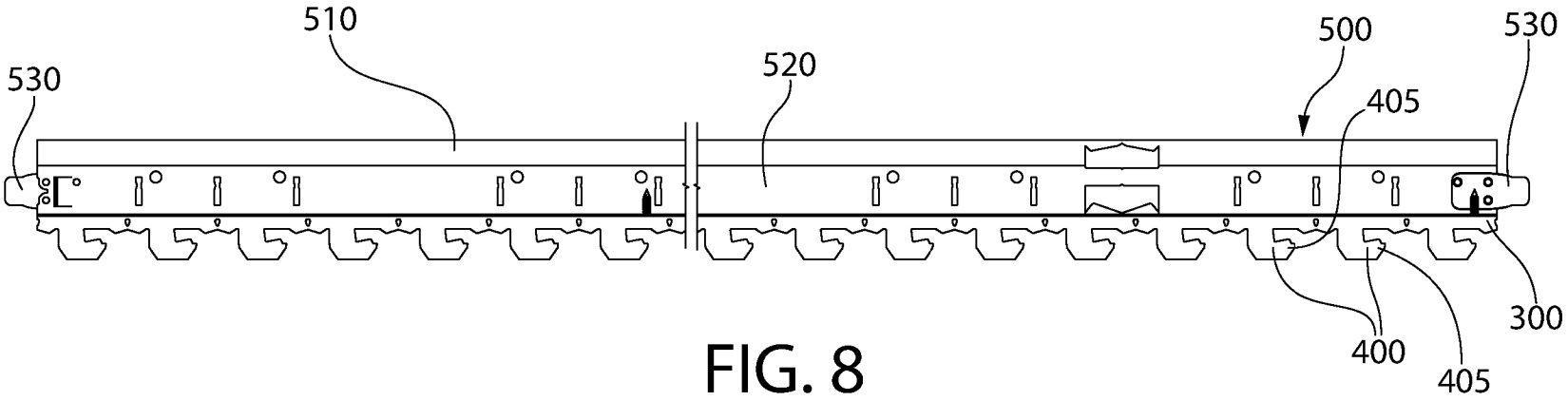
FIG. 8 is a side view of the embodiment shown in FIG. 7.

FIG. 8 shows main beam 500 with connection brackets 530 on each of its ends. Two main beams 500 can be connected end-to-end by way of a splicing feature such as, for example, one or more connection brackets 530 that attach, in this example, to web 520. Connection brackets 530 are shown as an example of one way to connect two main beams 500. Other methods of connecting two main beams can also be used, such as, for example, forming a protrusion in the main beam itself that overlaps a second main beam and can be screwed to the second main beam.

Figure 9:
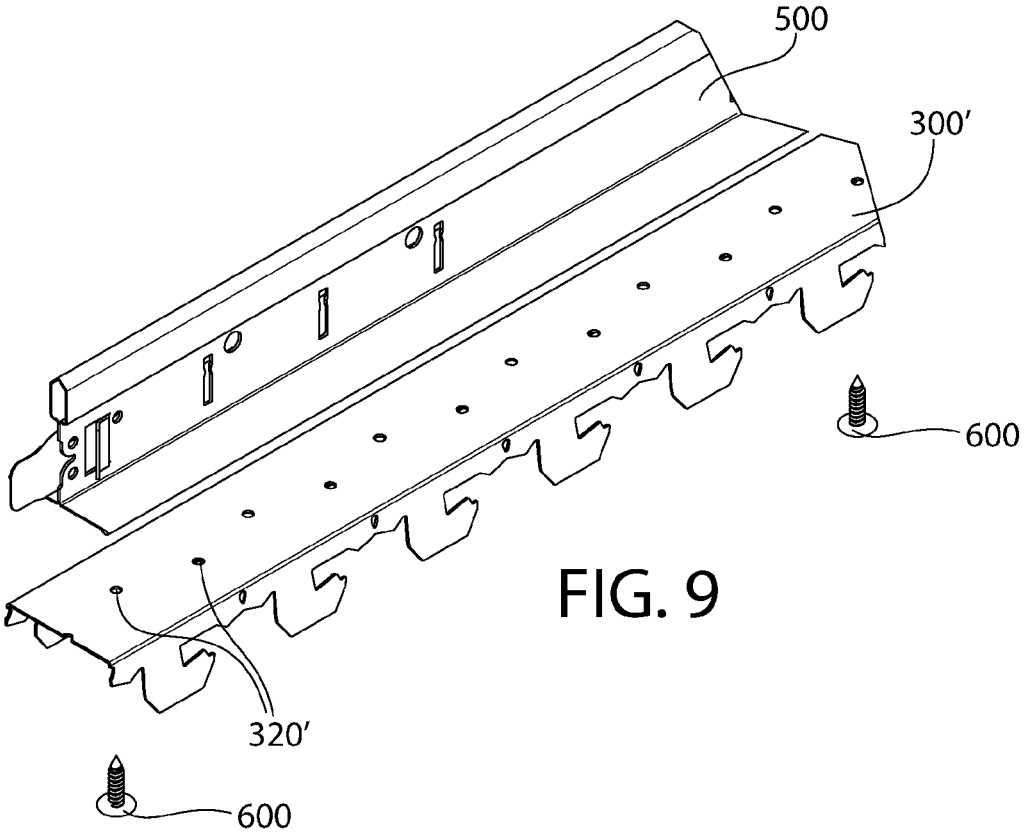
FIG. 9 is a perspective view of a main beam and carrier assembly in accordance with exemplary embodiments of the invention.

FIG. 9 shows an alternate example of carrier 300' that has holes 320' placed in slightly different locations (relative to hook members 400) than carrier 300 as shown in FIG. 5. The different hole location can better suit particular installations depending on where carrier 300 is cut.

Figure 10:
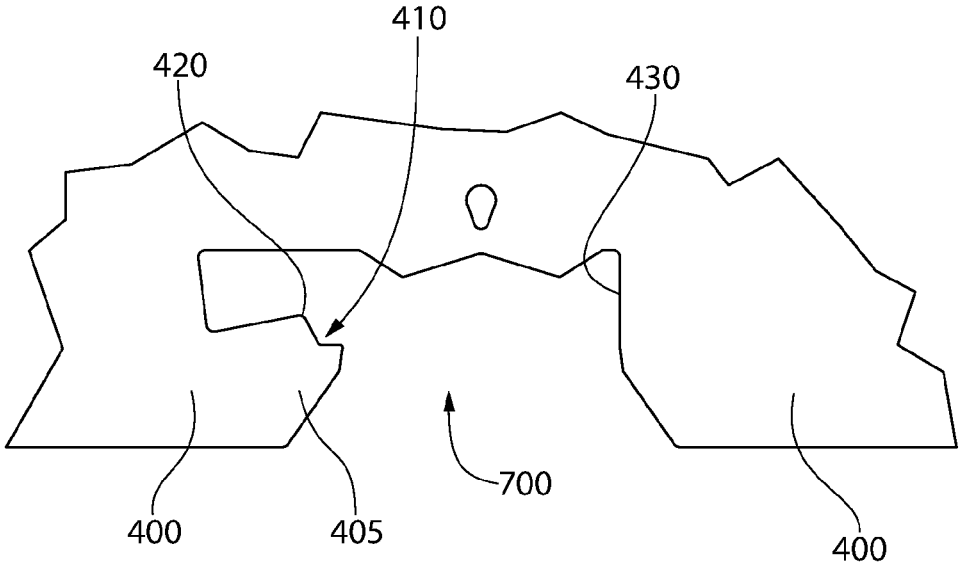
FIG. 10 is a side view of an opening in a carrier in accordance with exemplary embodiments of the invention.

FIG. 10 shows a specific example of the shape of opening 700 as formed by two adjacent hook members 400. The shape shown in FIG. 10 is best described in conjunction with FIG. 15. In this example, hook member 400 has the hooking portion 405 protruding in one direction only (to the right in FIG. 10) and has a notch 410 formed on the corner of hooking portion 405. Notch 410 provides an engagement feature for a first end 150 of a first panel (see FIG. 15). Hook member 400 has a corner 420 on an upper area of hooking portion 405 that provides a support for a second end 130 of a second panel (see FIG. 15). Second end 130 of a second panel rests on one or both of corner 420 and first end 150 of a first panel (see FIG. 15) in an installed state. Hook member 400 also has a wall 430 that provides a bearing surface for a second rising portion 120 of the panel. In some embodiments, the panel is held in position on the carrier by a spring pressure exerted on notch 410 and wall 430, although this is not required in all embodiments.

Figure 11:
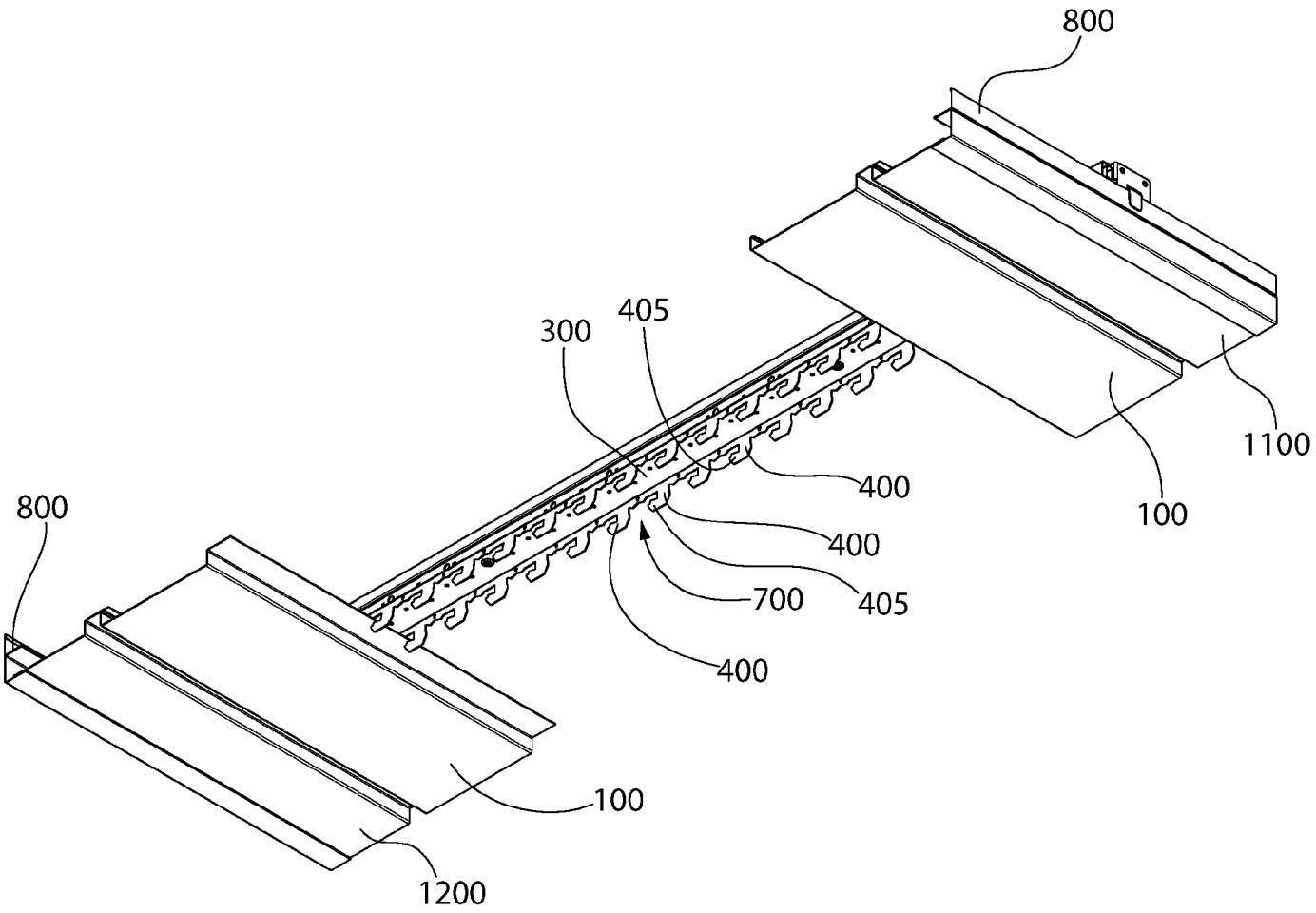
FIG. 11 is a perspective view from below of a ceiling system in accordance with exemplary embodiments of the invention.

FIG. 11 is a perspective view from below of a ceiling system in accordance with an exemplary embodiment of the invention. In this example, a perimeter frame 800 is provided at each of two opposite walls in a building space. One carrier 300 is attached at each end to one of the perimeter frames 800. A plurality of panels 100 are clipped onto carrier 300 to form a ceiling to the building space (some of the panels 100 are omitted in this drawing to show carrier 300). The panels at each end of the system in FIG. 11 are shown smaller than the full panels 100. When fitting a ceiling system to a particular building space, one or more panels might need to be cut for a proper fit. In this example, panels 1100 and 1200 are shown smaller than full panels 100. Embodiments of the invention include a bracket that retains these shortened panels 1100, 1200 so that they remain in place. These embodiments will be discussed in more detail below.

Figure 12:
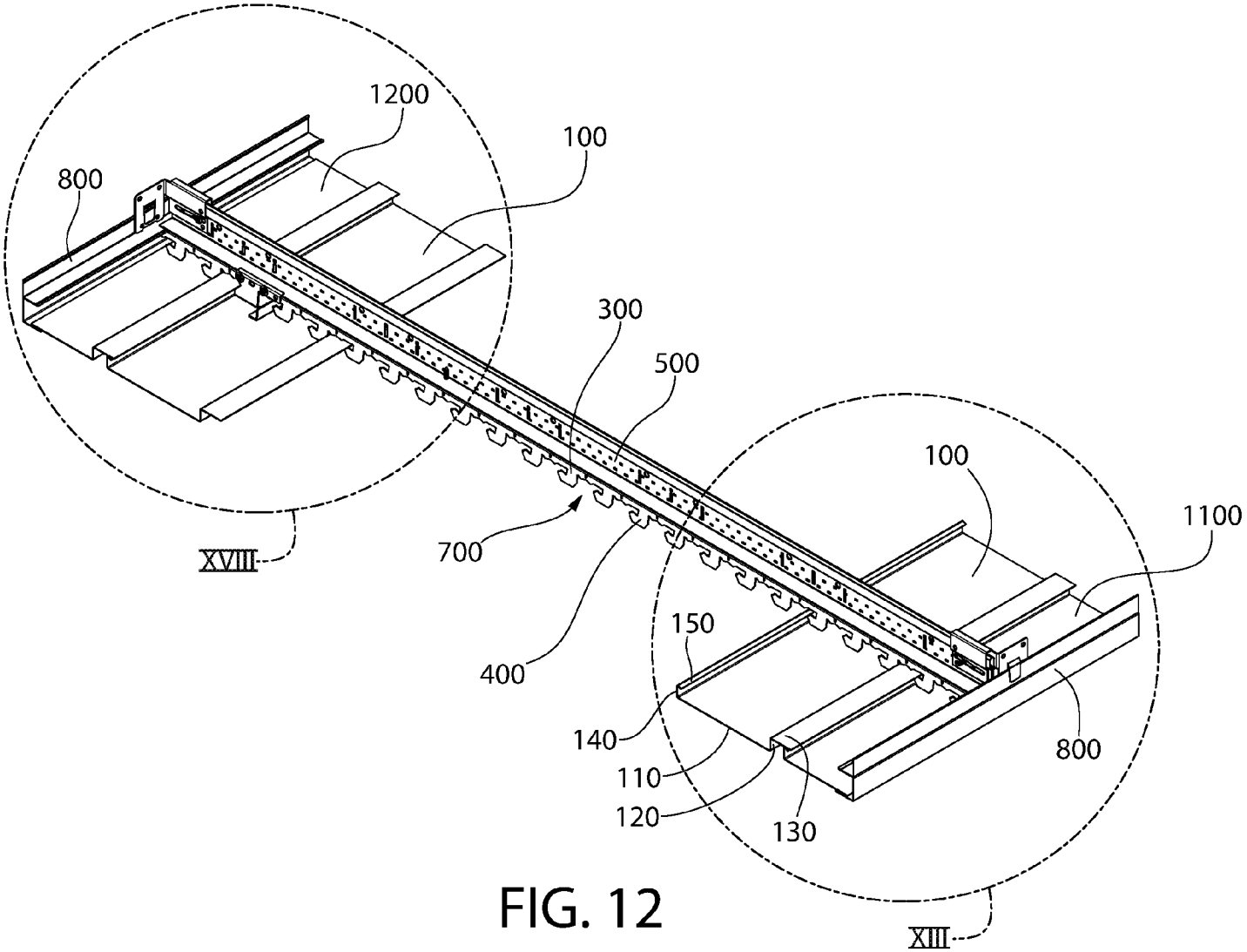
FIG. 12 is a perspective view from above of the ceiling system shown in FIG. 11.
Figure 14:
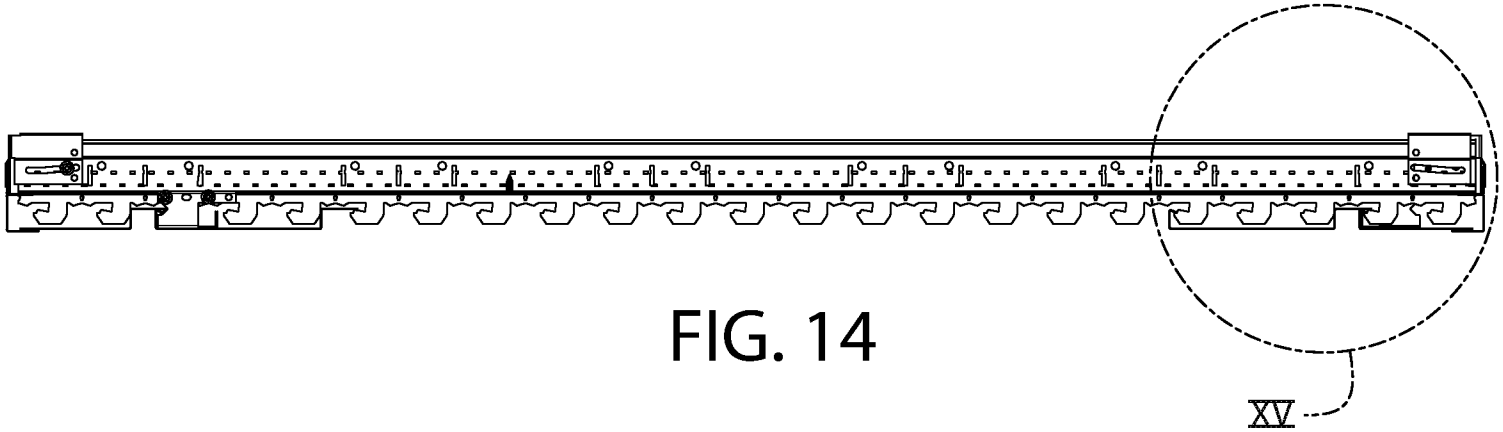
FIG. 14 is a side view of the ceiling system shown in FIG. 12.
Figure 15:
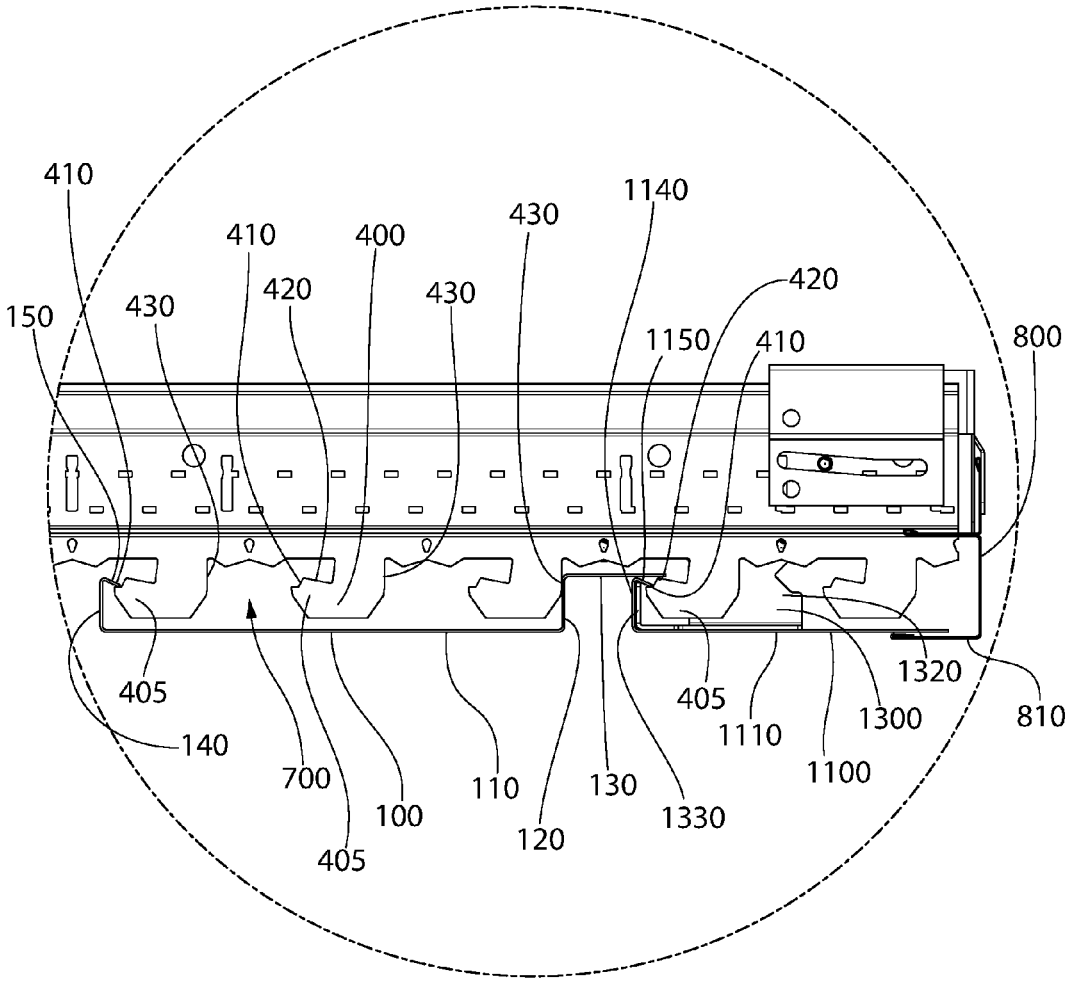
FIG. 15 is a larger scale view of a portion of FIG. 14.

FIG. 12 shows the ceiling system of FIG. 11, but from above, and FIG. 14 shows the ceiling system of FIG. 11, but from the side. FIG. 15 shows the right end portion of FIG. 14 at a larger scale for clarity. FIG. 15 shows a full panel 100 and a partial panel 1100 in the installed position. In this example, panel 100 spans three hook members 400. To install panel 100, a second end 130 of panel 100 is inserted into an opening 700 with panel 100 being held at an angle relative to carrier 300. Panel 100 is then tilted toward horizontal as second end 130 contacts corner 420 of one hook member 400. As panel 100 continues to be tilted toward horizontal, a first end 150 of panel 100 slides over another hook member 400 and engages a notch 410 in hooking portion 405. As first end 150 engages notch 410, a second rising portion 120 of panel 100 slides past a wall 430 of hook member 400. In this embodiment, in an installed state, panel 100 is then prevented from moving to the left in FIG. 15 by second rising portion 120 coming into contact with wall 430. All of the panels of the ceiling system are then installed in a like manner, except for cut panels that are, for example, closest to the walls or around a light, diffuser, vent, sensor, sprinkler, or other obstruction.

Figure 16:
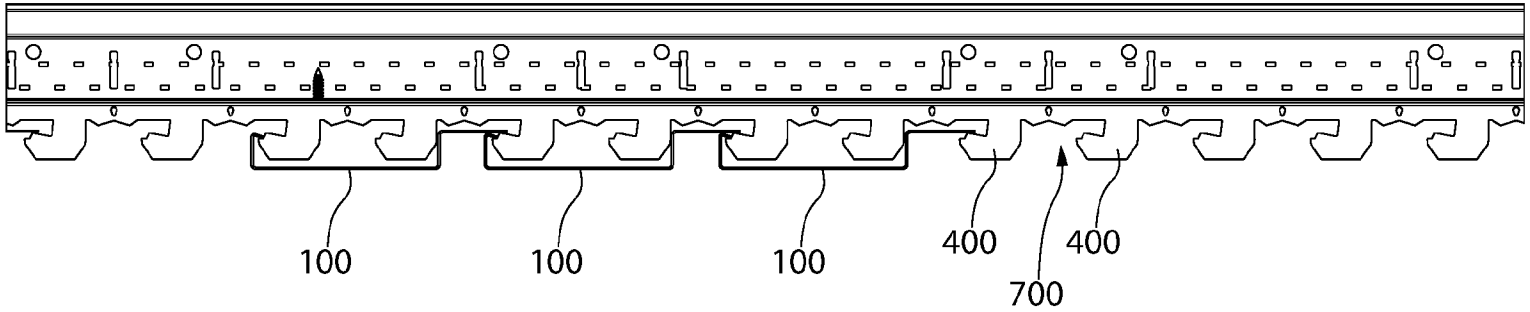
FIG. 16 is a side view of an alternate embodiment of the ceiling system shown in FIG. 12.
Figure 17:
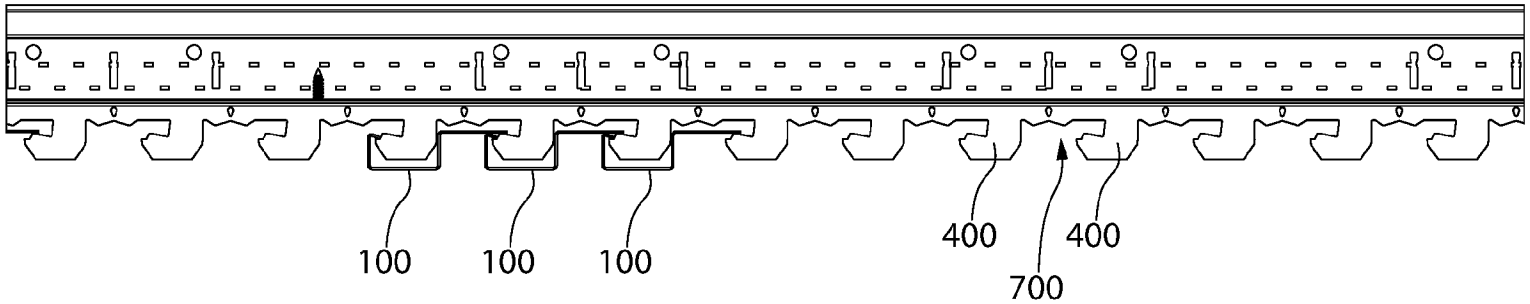
FIG. 17 is side view of an alternate embodiment of the ceiling system shown in FIG. 12.

As mentioned above, a feature of a carrier in accordance with the invention is that panels of different sizes can be used with one universal carrier design. FIGS. 16 and 17 show two examples of different size panels being used with a universal carrier 300. FIG. 16 shows panels 100 that bridge two hook members 400, while FIG. 17 shows panels 100 that bridge only one hook member 400. In particular embodiments, hook members 400 are arranged on two inch centers so that panels 100 having nominal sizes equal to integer multiples of two inches (2", 4", 6", 8", 10", etc.) can be used with the same universal carrier 300. It is also noted that different size panels can be used on carrier 300 at the same time. In other words, for example, 4 inch and 6 inch panels can be alternated to give a particular esthetic result.

Because the panels that are closest to the walls of the building space often need to be cut in order to properly fit in the space that is left between the last full panel and the perimeter frame 800, either first end 150 or second end 130 of a panel ends up being removed. Removal of either end of panel 100 prevents the normal installation method described above from being used. Embodiments of the invention provided a special bracket for use in these situations.

As mentioned above, a problem can exist in related art systems when a panel has to be cut at, for example, the end of a particular ceiling installation in order to fit within the space left before a wall, light, diffuser, vent, sensor, sprinkler, or other obstruction. With some related art systems, this last panel can either (1) be left loose and be subject to falling from the ceiling (for example as a result of an earthquake), or (2) be fastened into place by screwing or riveting the panel to the perimeter frame. Neither of these solutions is ideal in that they either risk disassembly of the ceiling system or esthetically unpleasing fasteners being visible. In addition, in some applications it is preferable for the cut panel to be attached to the carrier, but not to the perimeter frame. For example, particular installations in earthquake zones may require that the panel be allowed to move relative to the perimeter frame in order to reduce the risk of damage to the panel in the event of an earthquake.

Figure 18:
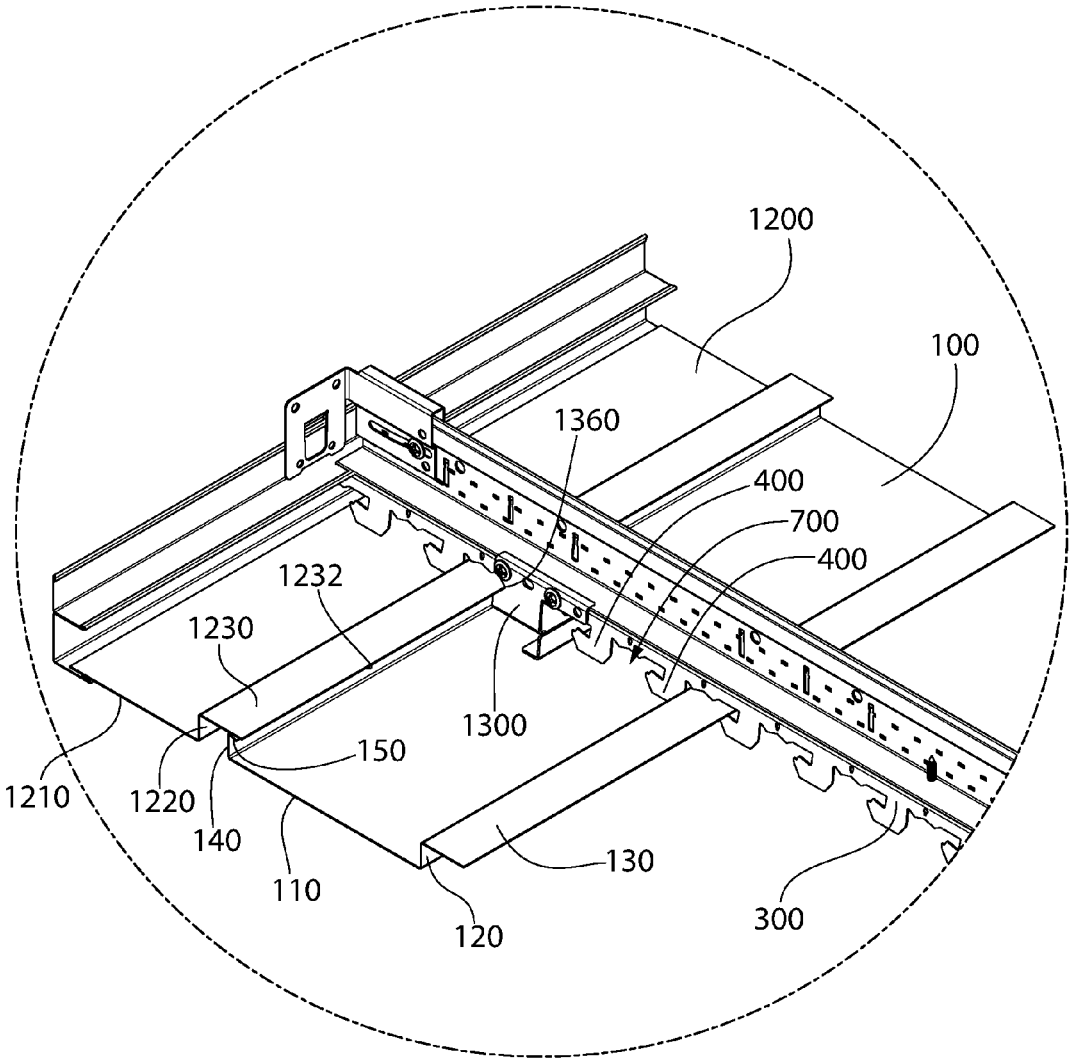
FIG. 18 is a larger scale view of a portion of FIG. 12.
Figure 19:
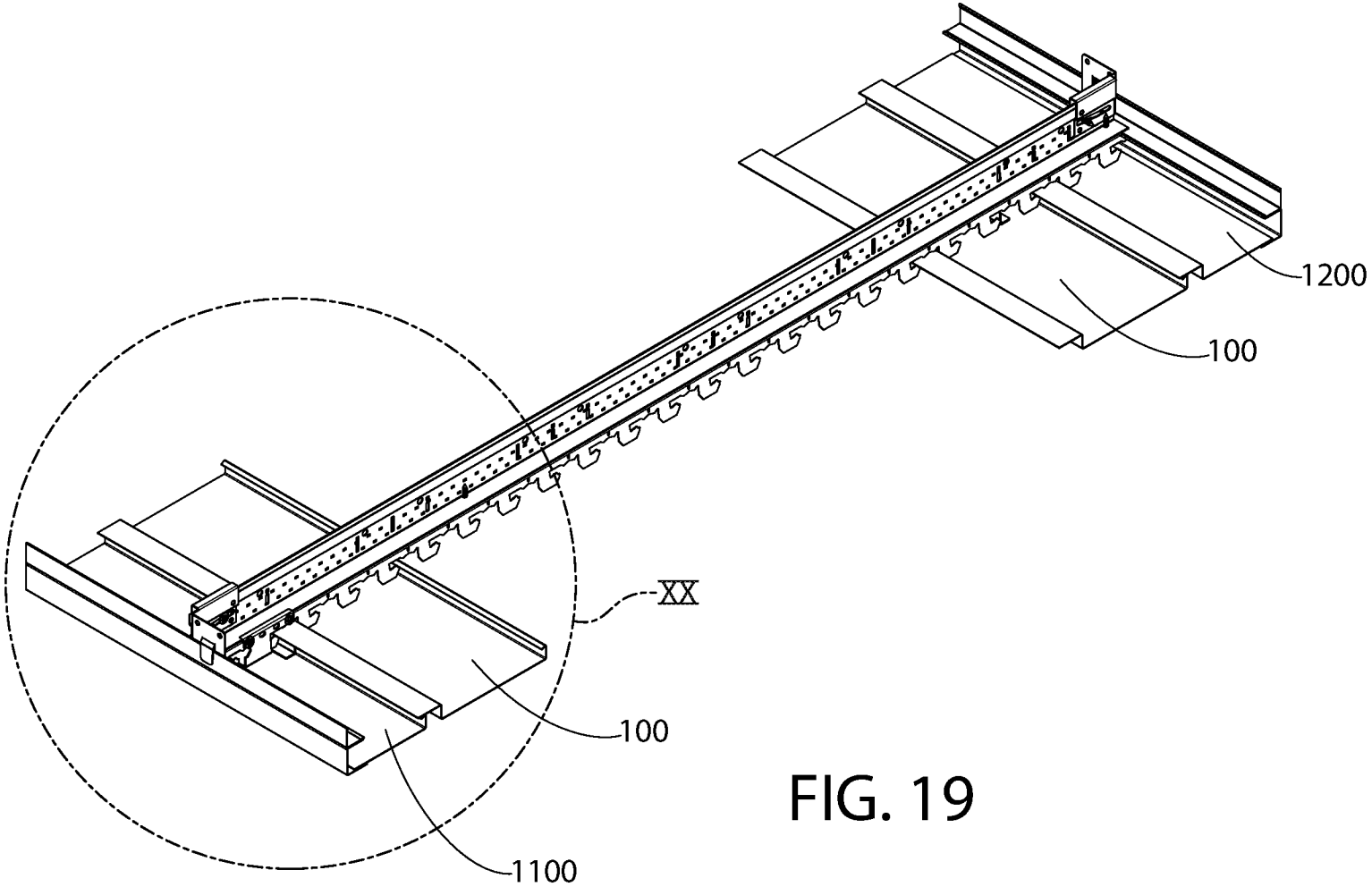
FIG. 19 is a perspective view from above of the ceiling system shown in FIG. 11.

FIG. 12 shows the two situations where a cut panel is used at the end of a run of ceiling. These two situations are shown in larger scale in FIGS. 15 and 18. FIG. 15 shows the situation in which second end 130 and second rising portion 120 are removed from panel 1100 in order to make panel 1100 shorter. FIG. 18 shows the situation in which first end 150 and first rising portion 140 are removed from panel 1200 in order to make panel 1200 shorter.

In the situation shown in FIG. 15, without second rising portion 120 to contact wall 430, panel 1100 can tend to move to the left in FIG. 15 and first end 1150 can become disengaged with notch 410. This situation is also shown in FIG. 20.

Embodiments of the invention provide a universal bracket 1300 (see FIGS. 21-25) that prevents panel 1100 from moving in both of these above situations without using unsightly visible fasteners. Bracket 1300 has a base 1310 from which a middle portion 1320 extends at an angle that matches the portion of carrier 300 against which bracket 1300 will be located. In some exemplary embodiments, this angle is approximately 85 degrees, in other exemplary embodiments, this angle is a right angle. However, other angles can also be used. A ledge 1330 extends, in this example, from base 1310 at a right angle and a shelf 1340 extends from middle portion 1320, in this example, at an angle such that shelf 1340 is parallel to base 1310. A number of holes 1350 are provided for fastening bracket 1300 to carrier 300. As shown in FIG. 20, bracket 1300 attaches to carrier by way of, in this example, two screws.

Figure 13:
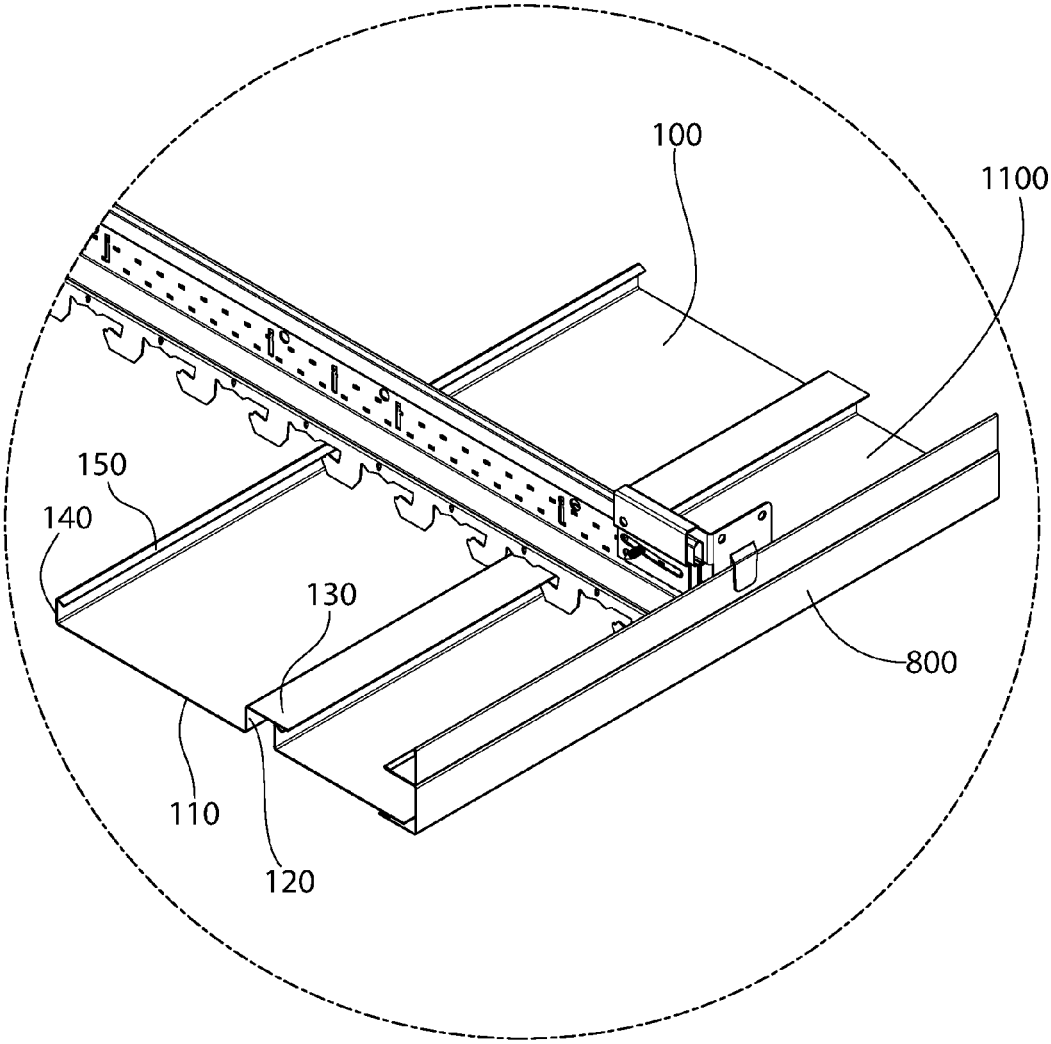
FIG. 13 is a larger scale view of a portion of FIG. 12.
Figure 20:
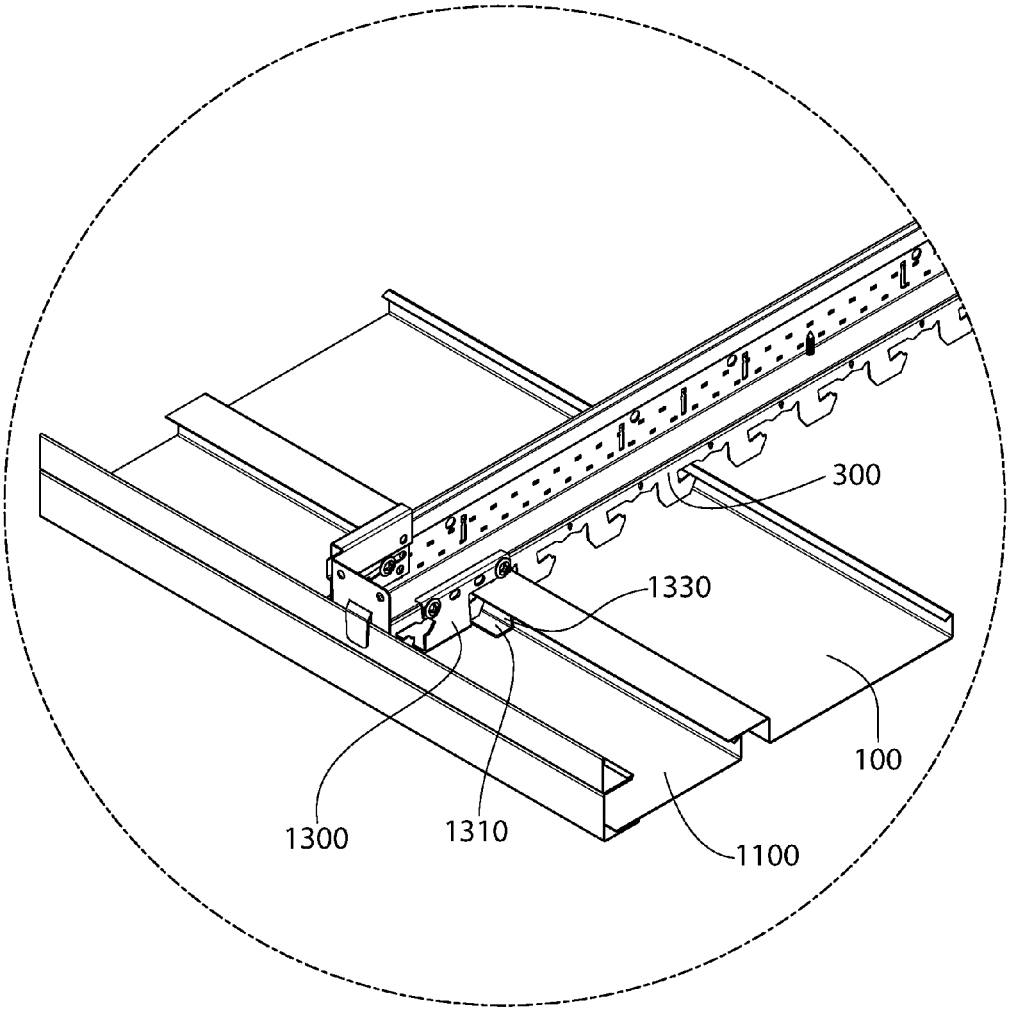
FIG. 20 is a larger scale view of a portion of FIG. 19.
Figure 21:
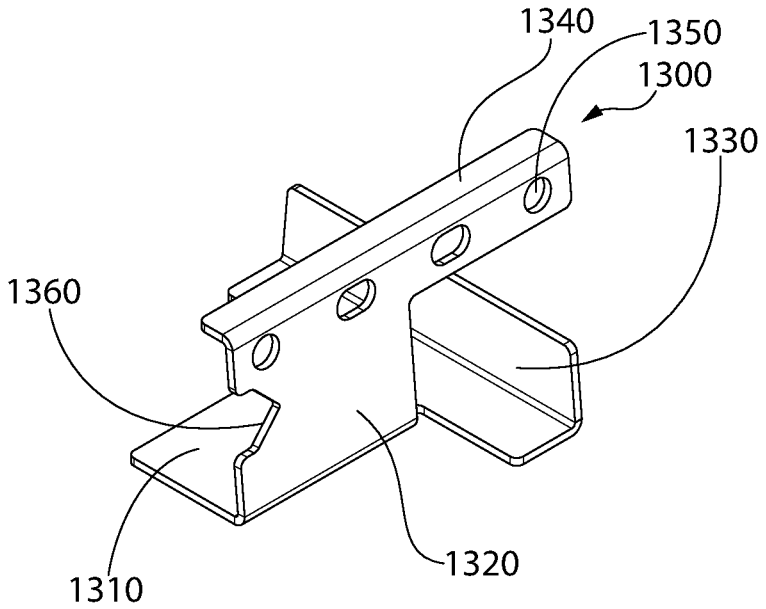
FIG. 21 is a perspective view of an exemplary embodiment of a support bracket for use with ceiling systems.
Figure 22:
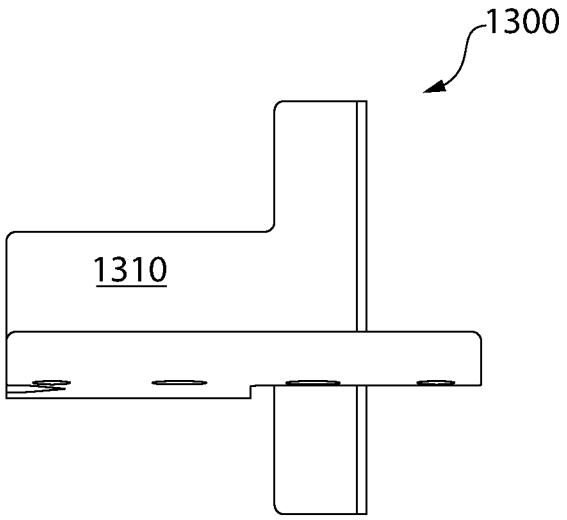
FIG. 22 is a top view of the bracket shown in FIG. 21.
Figure 23:
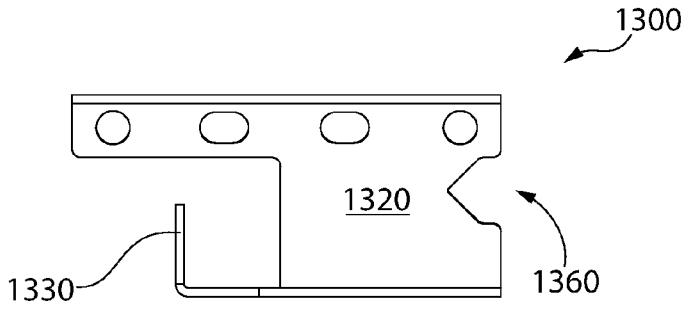
FIG. 23 is a side view of the bracket shown in FIG. 21.
Figure 24:
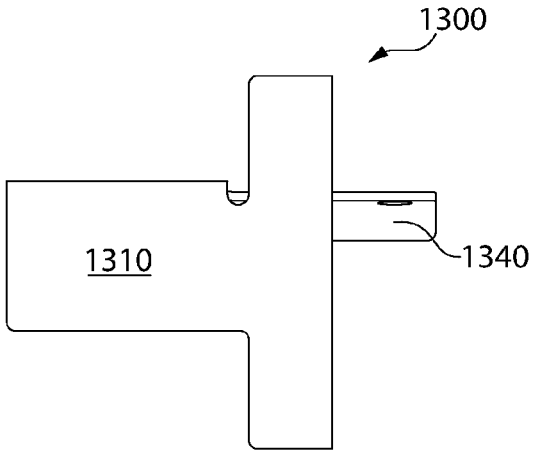
FIG. 24 is a bottom view of the bracket shown in FIG. 21.
Figure 25:
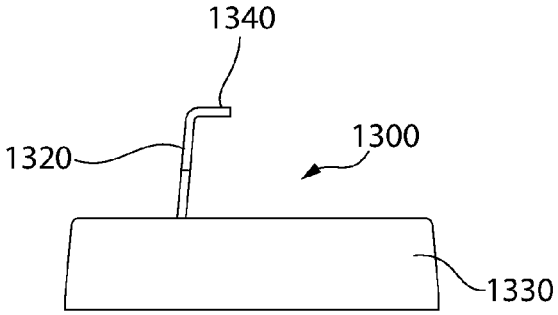
FIG. 25 is a back side view of the bracket shown in FIG. 21.

In the situation shown in FIGS. 13, 15 and 20, ledge 1330 is positioned against first rising portion 1140 of panel 1100 to provide resistance to first end 1150 from disengaging notch 410 of hooking portion 405. Base 1310 also provides a surface that prevents lower surface 1110 of panel 1100 from rising up and away from the lower extension 810 of perimeter bracket 800.

In the situation shown in FIGS. 12 and 18, panel 1200 has a lower section 1210, a second rising portion 1220 and a second end 1230. Second end 1230 has an edge 1232 at its free end. Bracket 1300 is, in this example, screwed to carrier 300 so that notch 1360 of bracket 1300 is pressed against edge 1232 of panel 1200 and prevents panel 1200 from moving to the right in FIG. 18. In the case of full panel 100 in FIG. 18, first end 150 engages notch 410 of hooking portion 405 to prevent panel 100 from moving to the right in FIG. 18. Because the first end of panel 1200 has been removed, without bracket 1300 panel 1200 would be free to move to the right in FIG. 18.

Figure 26:
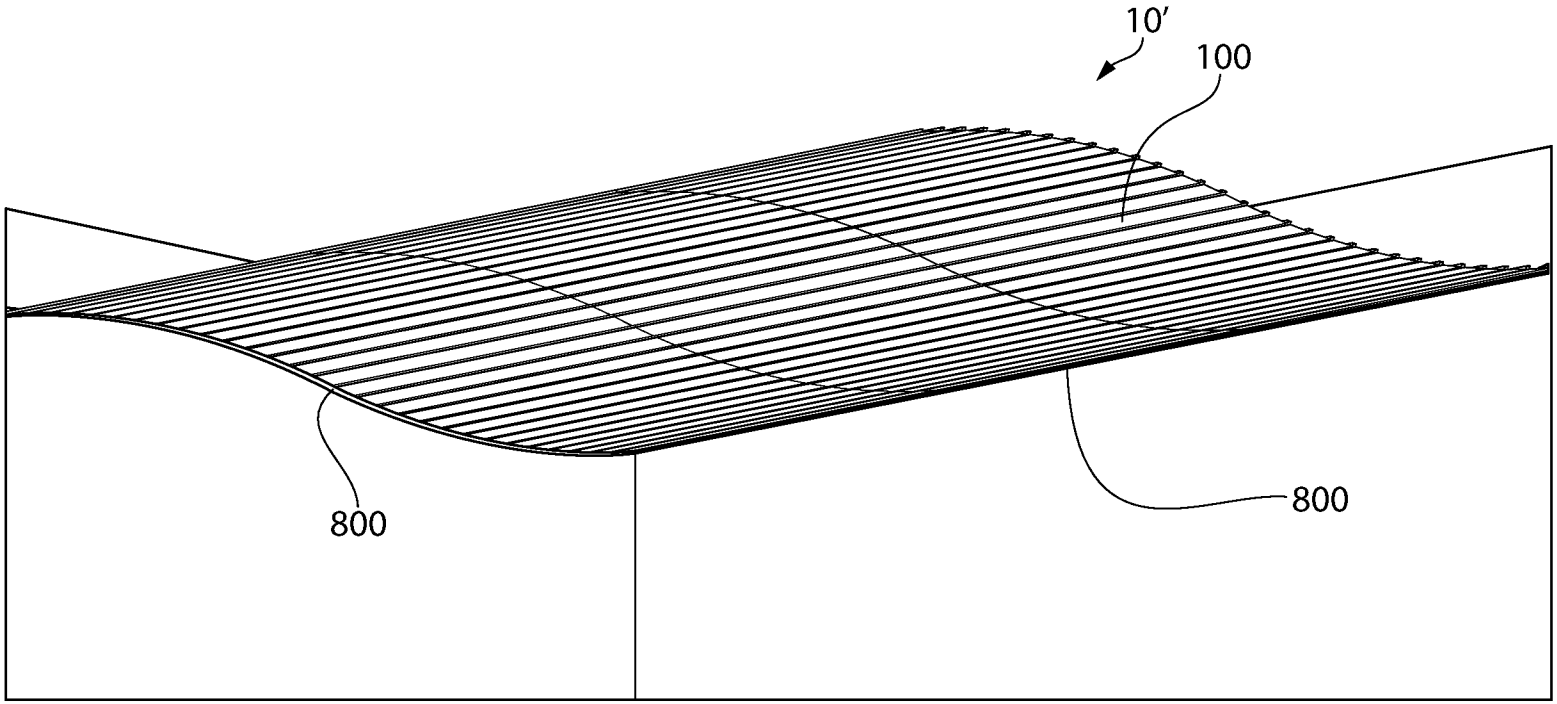
FIG. 26 is a view of a ceiling system according to an alternate exemplary embodiment of the invention in an installed condition.

FIG. 26 shows an alternate embodiment of the invention in which the ceiling system 10' produces a curved or wave shape. This is just one example of the various shapes that can be created using systems, such as, for example, ceiling and wall systems, in accordance with the invention.

As can be seen from this disclosure, the invention provides a solution to the problem of having to manufacture, inventory, and supply different carriers for each panel size and provides a solution to the problem of cut end panels not being securely fastened to the carrier.

What is claimed is:

1. A building panel system comprising:

a perimeter frame;

a main beam attached to the perimeter frame;

a carrier attached to the main beam, the carrier having a plurality of identical hook members including a first hook member and a second hook member, each of the hook members having a protruding hooking portion on only a first side of the hook member, and a non-hooking portion on a second side of the hook member, the second side being opposite the first side; and a plurality of panels removably attached to the carrier, each of the panels being attached to the carrier by engaging one of the hooking portions, wherein one of the plurality of panels contacts both the protruding hooking portion of the first hook member and the protruding hooking portion of the second hook member.

2. The building panel system of claim 1, wherein the one of the plurality of panels is attached to the carrier by directly contacting both the protruding hooking portion of the first hook member and the second hook member.

3. The building panel system of claim 1, wherein the panels are ceiling panels.

4. The building panel system of claim 1, wherein the panels are wall panels.

5. The building panel system of claim 1, wherein each of the plurality of panels has a first end and a second end, the second end being opposite the first end along a longitudinal direction of the carrier, the first end incudes an engagement portion, and the second end extends along the longitudinal direction of the carrier.

6. The building panel system of claim 5, wherein the hooking portion has a notch that engages the engagement portion of one of the panels.

7. The building panel system of claim 5, wherein the hook member includes a wall opposite to the hooking portion, the wall contacting a rising portion of one of the panels, the rising portion being closer to the second end than the first end.

8. The building panel system of claim 1, wherein the carrier has two parallel rows of the hook members.

9. The building panel system of claim 1, wherein each of the panels has a first end and a second end, the building panel system further comprising an end panel bracket, the end panel bracket having a notch configured to engage an edge of an uncut end of a first panel of the plurality of panels, the first panel having its first end cut off, the notch preventing movement of the first panel in a longitudinal direction of the carrier; and a ledge configured to contact an inside surface of an uncut end of a second panel of the plurality of panels, the second panel having its second end cut off, the ledge supporting the second panel to prevent movement of the second panel in a longitudinal direction of the carrier, wherein the universal end panel bracket is configured to be attached to the carrier.

10. A building panel system comprising:

a perimeter frame;

a main beam attached to the perimeter frame;

a carrier attached to the main beam, the carrier having a longitudinal direction and a plurality of identical hook members arranged along the longitudinal direction, each of the hook members having a first side and a second side opposite the first side, the first side and the second side being arranged relative to each other along the longitudinal direction of the carrier, and the first side and the second side being non-symmetrical, and a protruding hooking portion on the first side; and a plurality of panels removably attached to the carrier including a first panel and a second panel, each of the panels being attached to the carrier by engaging one of the hooking portion, wherein the first panel engages one of the hooking portion at a first point and the second panel engages the same hooking portion at a second point, the first point being horizontally offset from the second point.

11. The building panel system of claim 10, wherein each of the panels is attached to the carrier by engaging two of the hooking portions.

12. The building panel system of claim 10, wherein the panels are ceiling panels.

13. The building panel system of claim 10, wherein the panels are wall panels.

14. The building panel system of claim 10, wherein each of the plurality of panels has a first end and a second end, the second end being opposite the first end along a longitudinal direction of the carrier, the first end incudes an engagement portion, and the second end extends along the longitudinal direction of the carrier.

15. The building panel system of claim 14, wherein the hooking portion has a notch that engages the engagement portion of one of the panels.

16. The building panel system of claim 14, wherein the hook member includes a wall opposite to the hooking portion, the wall contacting a rising portion of one of the panels, the rising portion being closer to the second end than the first end.

17. The building panel system of claim 10, wherein the carrier has two parallel rows of the hook members.

18. The building panel system of claim 10, wherein each of the panels has a first end and a second end, the building panel system further comprising an end panel bracket, the end panel bracket having a notch configured to engage an edge of an uncut end of a first panel of the plurality of panels, the first panel having its first end cut off, the notch preventing movement of the first panel in a longitudinal direction of the carrier; and a ledge configured to contact an inside surface of an uncut end of a second panel of the plurality of panels, the second panel having its second end cut off, the ledge supporting the second panel to prevent movement of the second panel in a longitudinal direction of the carrier, wherein the universal end panel bracket is configured to be attached to the carrier.

* * * * *